US007735242B2

(12) United States Patent
Seliger et al.

(10) Patent No.: US 7,735,242 B2
(45) Date of Patent: Jun. 15, 2010

(54) BOOT

(75) Inventors: Sven Seliger, Soell (AT); Florin Strete, Innsbruck (AT)

(73) Assignee: DeeLuxe Sportartikel Handels GmbH, Kufstein (AT)

( * ) Notice: Subject to any disclaimer, the term of this patent is extended or adjusted under 35 U.S.C. 154(b) by 775 days.

(21) Appl. No.: 11/603,328

(22) Filed: Nov. 21, 2006

(65) Prior Publication Data

US 2007/0130799 A1 Jun. 14, 2007

(30) Foreign Application Priority Data

Nov. 24, 2005 (DE) ..... 10 2005 056 077

(51) Int. Cl.
*A43B 5/04* (2006.01)

(52) U.S. Cl. ..... 36/50.5; 36/117.1

(58) Field of Classification Search ..... 36/50.1, 36/50.5, 117.1

See application file for complete search history.

(56) References Cited

U.S. PATENT DOCUMENTS

| | | | | | |
|---|---|---|---|---|---|
| 2,124,310 | A * | 7/1938 | Murr, Jr. | 36/50.1 |
| 4,408,403 | A * | 10/1983 | Martin | 36/115 |
| 5,333,398 | A * | 8/1994 | Seo | 36/50.1 |
| 5,566,474 | A * | 10/1996 | Leick et al. | 36/50.1 |
| 5,755,044 | A * | 5/1998 | Veylupek | 36/50.1 |
| 6,324,774 | B1 * | 12/2001 | Zebe, Jr. | 36/50.1 |
| 6,467,195 | B2 * | 10/2002 | Pierre et al. | 36/50.5 |
| 6,474,000 | B2 * | 11/2002 | Burt | 36/50.1 |
| 6,775,928 | B2 * | 8/2004 | Grande et al. | 36/50.1 |
| 6,802,439 | B2 * | 10/2004 | Azam et al. | 223/113 |
| 2005/0097780 | A1 * | 5/2005 | Pellegrini | 36/54 |
| 2006/0000116 | A1 * | 1/2006 | Brewer | 36/50.1 |
| 2006/0174516 | A1 * | 8/2006 | Peruzzo | 36/50.5 |
| 2006/0185193 | A1 * | 8/2006 | Pellegrini | 36/50.1 |

FOREIGN PATENT DOCUMENTS

| | | |
|---|---|---|
| DE | 10116779 | 7/2002 |
| DE | 20318638 | 6/2004 |
| DE | 202004019082 | 5/2005 |
| DE | 102004044801 | 7/2005 |
| EP | 0153399 | 9/1985 |
| EP | 11377351 | 7/2003 |
| EP | 1356746 | 10/2003 |
| EP | 1541049 | 6/2005 |
| WO | WO 9728713 A1 * | 8/1997 |
| WO | 0147386 | 7/2001 |
| WO | 2004093589 | 11/2004 |

* cited by examiner

*Primary Examiner*—Marie Patterson
(74) *Attorney, Agent, or Firm*—The Webb Law Firm

(57) ABSTRACT

The invention relates to a boot comprising a lacing arrangement having a single bootlace. The lacing arrangement comprises three zones of action, namely an upper, middle and lower zone of action, the middle zone of action, in respect of lacing up and opening, having a direct functional connection both to the upper zone and to the lower zone.

8 Claims, 1 Drawing Sheet

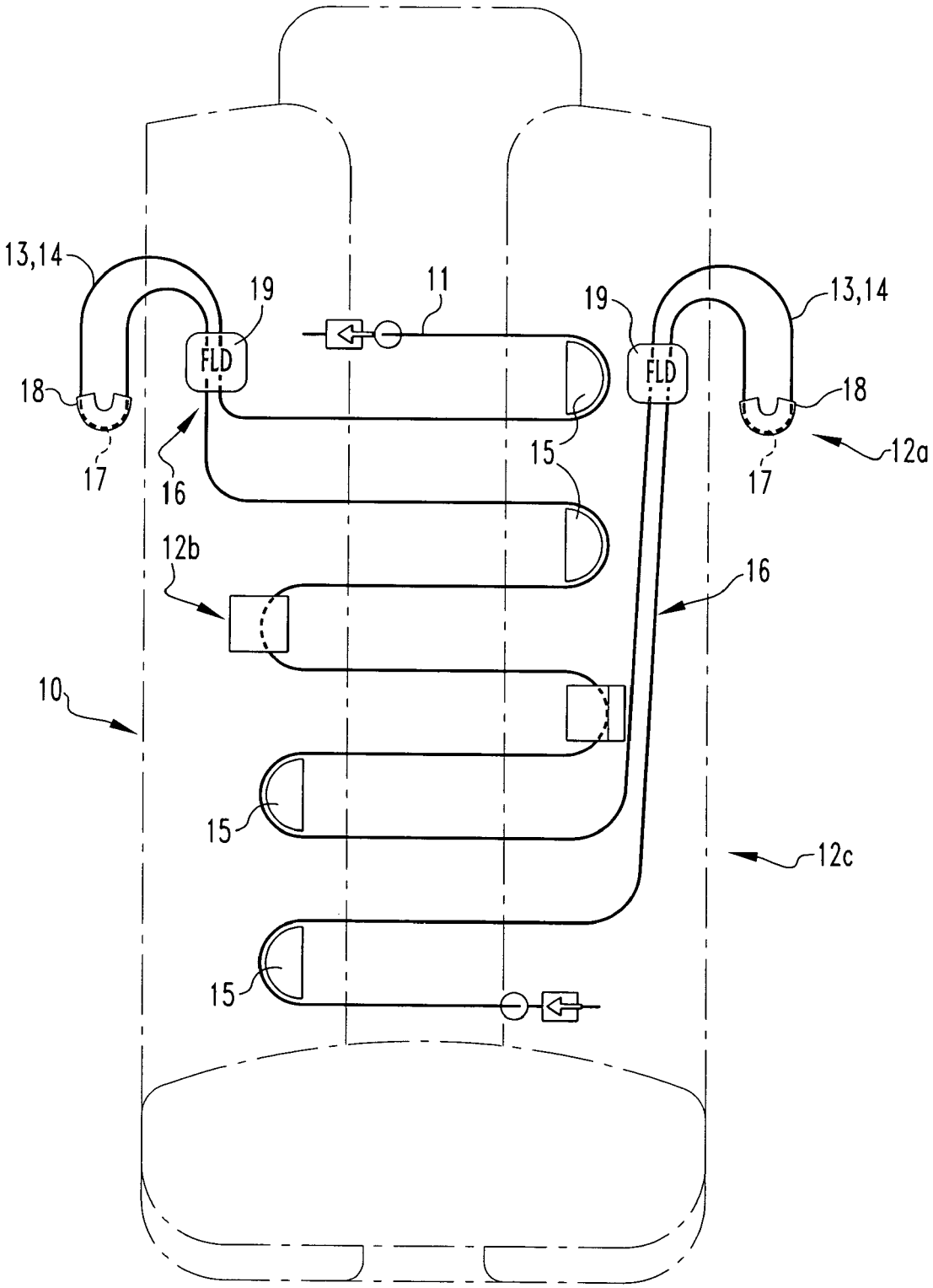
13,14
19
11
19
13,14
FLD
FLD
18
18
17
16
15
17
12a
12b
16
10
15
12c
15

BOOT

The invention relates to a boot.

Boots are used in various fields of sport, for example in mountain climbing, skiing and snowboarding, it being important in the first instance that in use the boot ensures secure support, especially in the foot region, without the boot's cutting into the bend of the foot. Furthermore, the boot should sit sufficiently firmly in the region of the shin in order to transfer the force of the user, especially in the case of skiing or snowboarding, to the sports equipment in question.

In addition to the firm support which a boot should offer, it must also be capable of being laced up in such a way that the user can easily put on and take off the boot with relatively little effort.

DE 20 2004 019 082 U1 discloses a boot the lacing arrangement of which consists of two bootlaces. One bootlace is used for lacing up the boot in the leg region, whereas the other bootlace is provided for lacing up the foot region. For that purpose, the bootlace associated with the foot region is attached to the boot by one end. In the foot region, the bootlace is guided through three guide hooks which are each mounted to the side of the boot tongue. After the third guide hook, the free end of the lower bootlace is guided upwards along the leg of the boot, where the lace ends in a grip tab.

The upper bootlace associated with the leg of the boot is joined to the boot and guided in the boot in an analogous way.

The two bootlaces are operable independently of one another, so that a first upper lacing zone in the region of the leg of the boot can be tightened or loosened independently of a second lower lacing zone in the region of the foot portion of the boot. As a result of the two separate lacing zones in the leg and foot region of the boot, at least in some areas there is no lacing acting on the transition region between the two zones, that is to say in the region of the bend of the foot.

There is therefore a risk that insufficient tension will be built up in the region of the bend of the foot so that the secure support in the boot is impaired. In addition, it has been found that to remove the boot it is necessary to loosen both the upper and the lower zones. Because the two lacing arrangements act independently of one another, it is not sufficient merely to slacken the upper lacing zone, because the foot is held firmly by the lower lacing arrangement, and it is not possible to step out of the boot easily.

The problem underlying the invention is to provide a boot the lacing arrangement of which offers secure support in the entire boot, while the boot should be as simple as possible to put on and take off.

That problem is solved according to the invention by a boot having the features of patent claim 1, advantageous structural details and embodiments being described in the subsidiary claims.

An important aspect of the invention is, therefore, that the boot comprises a lacing arrangement having a single bootlace, the lacing arrangement having three zones of action: an upper, middle and lower zone of action. In respect of lacing up and opening the boot, the middle zone of action has a direct functional connection both to the upper zone of action and to the lower zone of action. Unlike the known boot, therefore, the boot according to the invention does not have two separate bootlaces, but has a single bootlace. By virtue of the single bootlace and the three zones, it is ensured that in the region of the bend of the foot, that is to say in the region of the middle zone of action, the tension built up when the boot is laced up is sufficient to ensure that the foot is securely supported in the boot even in the region of the bend of the foot. As a result of the functionally connected zones of action, furthermore, it is ensured that loosening of the upper zone of action also brines about a slackening of the single bootlace in the region of the middle zone of action and, at least to a certain extent, also in the lower zone of action, so that slackening the lacing arrangement merely in the region of the upper zone of action enables the boot to be taken off easily. Furthermore, the middle zone of action, as a result of its having a functional connection to the two adjacent zones, acts as a tension-equalising zone, with the result that the lacing arrangement of the boot is tightened uniformly. As a consequence, both the wearing comfort and the support in the boot are improved.

In an especially preferred embodiment of the invention, the upper and lower zones of action are each associated with a lockable lace-tightening device. By means of the lace-tightening devices, which are associated with both zones of action, it is advantageously possible for the tension both in the forefoot and in the leg to be adjusted individually and separately, the middle zone of action acting as a tension-equalising zone, so that overall a uniform distribution of pressure is built up in the boot. The lace-tightening devices allow, in particular, a progressive build-up of pressure in the boot, without the need for an elaborate lacing arrangement in order, as in conventional boots, to tighten the lace first in the region of the forefoot and then in the region of the leg. By virtue of the middle zone of action (tension-equalising zone), a distribution of pressure in the sensitive bending region is achieved so that the boot is prevented from cutting into the region of the bend of the foot. In terms of comfort when the boot is being put on and taken off, such an embodiment makes it possible, by loosening of the lace-tightening device associated with the upper zone of action, to loosen the lacing arrangement as a whole by means of a single hand grip tab, because the upper zone of action has a functional connection to the middle and lower zones of action. Loosening of the lacing arrangement in the region of the upper zone of action is therefore continued into the middle and lower zones of action.

By locking the lace-tightening device, the lacing arrangement of the upper and lower zones of action can each be determined individually.

Preferably, the upper and lower zones of action each comprise a plurality of lace guide hooks, the lace-tightening device being arranged between two lace guide hooks, especially two directly consecutive lace guide hooks. Such an arrangement of the lace-tightening device enables force to be transmitted especially efficiently from the lace-tightening device to the boot lacing arrangement, because the transmission of force is effected by way of the respective lace guide hooks in both directions of the lacing arrangement. That has the result that the lacing arrangement in the upper and lower zones of action can be tightened by the application of relatively little force.

It has proved to be particularly advantageous for the lace-tightening device to comprise a portion of the bootlace that is in the form of an extended loop which can be manipulated for opening and closing the boot. That means that the bootlace loop provided in the region of a guide hook does not make contact with a guide hook but is extended to the extent that the extended loop can be manipulated for opening and closing the boot. For tightening the lacing arrangement, the loop is lockable (lockable lace-tightening device). Because the loop is not guided around a guide hook, but is extended, the guide hook in the region of the extended loop can be left out. That embodiment offers a particularly simple way of implementing the lace-tightening device, because the latter forms part of the bootlace which is in any case present. Moreover, in such an embodiment, the introduction of force from the lace-tightening device to the remainder of the bootlace is especially effective, because force is conveyed from the extended loop directly to the portions of the lace guided around the adjacent guide hooks.

The lace loop can be arranged in a guide provided in and/or on the boot, the free end of the lace loop being accessible for operating the lace-tightening device. The lace loop is thus prevented from becoming entangled with objects, for example with branches during snowboarding.

Ease of putting on and taking off is increased further by the free end of the lace loop's in each case being guided through a grip tab that is freely movable along the lace loop.

For locking the lace-tightening device, the lace loop can be guided through a lace lock attached to the boot, especially to the leg of the boot.

A particularly simple way of fixing the ends of the bootlace in position is to join them to the boot.

The invention will be described in greater detail below, with further details, by means of an exemplary embodiment referring to the accompanying drawing, which shows diagrammatically in the single FIGURE the structure of a lacing arrangement of a boot in accordance with an exemplary embodiment according to the invention.

The lacing arrangement shown in the single FIGURE can be used, for example, for a mountain boot or a soft boot for a snowboard, the use of the lacing arrangement for a soft boot being especially advantageous.

For the sake of clarity, only the lacing arrangement and not the entire boot is shown.

Unlike the lacing arrangement known from DE 20 2004 019 082 U1, the lacing arrangement 10 of the boot according to the invention comprises a single continuous bootlace 11. The lacing arrangement 10 furthermore comprises three zones of action 12*a*, 12*b*, 12*c*, an upper zone of action 12*a* being arranged in the region of the leg of the boot and a lower zone of action 12*c* being arranged in the region of the forefoot. The middle zone of action 12*b* is arranged between the upper and lower zones of action 12*a*, 12*c* and acts in the bending region of the boot. The middle zone of action 12*b* has a direct functional connection to the upper and lower zones of action 12*a*, 12*c* and acts as a tension-equalising zone. As a result, a distribution of tension is achieved in the bending region, because tension established in the upper and/or lower zones of action 12*a*, 12*c* is transmitted at least partially to the middle zone of action 12*b*.

Moreover, the lacing arrangement 10 shown in the FIGURE enables the lacing tightness in the upper and lower zones of action 12*a*, 12*c* to be adjusted individually. It should be noted at this point that the middle zone of action 12*b*, which acts as tension-equalising zone, effects equalisation of tension only to a certain extent, so that it is entirely possible to establish different degrees of lacing tightness in the upper and lower zones of action 12*a*, 12*c*. To adjust the lacing tightness individually, the upper and lower zones of action 12*a*, 12*c* are each associated with a lockable lace-tightening device 13. By operation of the lace-tightening device 13, the upper and lower zones of action 12*a*, 12*c* can be tightened independently of one another, the lacing tightness established being maintained by locking the lace-tightening device 13.

In the example shown, the lace-tightening device 13 is in the form of an extended loop 14 which can be manipulated for opening and closing the boot. For that purpose, the portions of the lace coming from the guide hooks 15 arranged on one side of the boot tongue (not shown) are not, as is customary, guided by way of a guide hook arranged on the opposite side of the tongue. Instead, that guide hook is omitted and the two portions of the lace are extended to form a loop 14 that can be manipulated by the user of the boot, the lace portions being extended to such an extent that they can be guided through a lace lock 19 arranged in the region of the upper end of the leg, the free end 17 of the lace loop 14 extending beyond the lace lock 19 to such an extent that it can easily be grasped by the user. In practice, the length of the free end 17 of the lace loop 14 extending beyond the lace lock 19 constitutes at least the leg height of the boot.

To prevent the extended portions of the lace from becoming intertwined or entangled, they are arranged in a guide 16 which is provided in and/or on the boot. The guide comprises two flexible tubes which are incorporated into or fixed in the boot material. A tongue-side end of the two tubes is in each case arranged between or at about the same height as the guide hooks 15 of the lower and upper zones of action 12*a*, 12*c*. The two tongue-side ends of the tubes are arranged spaced apart from one another and from the guide hooks 15 so that the bootlace extends substantially horizontally from the guide hooks 15 into the guide tubes. The tubes can also be so arranged that the bootlace portions run into the tubes at an angle which can be so selected that the lacing angle of the bootlace is uniform over the entire lacing arrangement.

Below the lace lock 19, the two lace portions pass out of the guide and into the lace lock 19, with the result that only a very short portion of the lace lies freely on the boot, so that the lace is prevented from becoming caught.

The free end 17 passes through a grip tab 18 that is freely movable along the lace loop 14, which grip tab 18 enables the lace loop 14 or the lacing arrangement 10 to be tightened easily.

The lace loops 14 of the lower and upper zones of action 12*a*, 12*c* are correspondingly constructed, the lace portions of the lace loop 14 of the upper zone of action 12*a* being shorter than the lace portions of the lace loop 14 associated with the lower zone of action 12*c*, so that the free ends 17 of the two lace loops 14 are each arranged at the same height.

The two ends of the continuous bootlace 11 are in each case attached in the region of the boot leg or the lower region of the forefoot (not shown).

Instead of the two guide hooks 15 per upper and lower zone of action 12*a*, 12*c*, as shown in the single FIGURE, it is also possible for a different number of guide hooks to be selected. For example, four or six guide hooks can be provided, it not being absolutely necessary to provide the extended lace loop 14 between two directly consecutive guide hooks. Instead, further guide hooks can be provided between the two lace portions of the lace loop 14.

Instead of the extended lace loop 14, the lace-tensioning device 13 can comprise, for example, two tapes, each of which engages a free loop of the upper or lower zone of action 12*a*, 12*c*.

For lacing up or loosening the boot, the lacing arrangement shown in the single FIGURE is operated as follows: by pulling on the lace loop 14 associated with the upper zone of action 12*a*, the lacing arrangement is tightened in that region, so that the lacing tightness of the boot in the shin region can be adjusted. The lacing tightness in the region of the forefoot is achieved by pulling on the lace loop 14 associated with the lower zone of action 12*c*. Because the middle zone of action 12*b* has a direct functional connection to the upper and lower zones of action 12*a*, 12*c*, an equalisation of tension between the upper and lower zones of action 12*a*, 12*c* takes place up to a certain extent, the individually adjusted lacing tightness of the respective zone being substantially retained. By virtue of the equalisation of tension by way of the middle zone of action 12*b*, the bending region of the boot is also acted upon by a certain degree of tension, so that the foot is securely supported even in the bending region, without the boot's cutting into the sensitive bend of the foot.

The overall result is that the foot is held extremely comfortably and at the same time firmly and securely in the boot.

For stepping out of the boot it is sufficient to loosen the lace lock 19 associated with the upper zone of action 12*a*, because slackening the lacing arrangement in the region of the upper zone of action 12*a* results also in a slackening in the middle and lower zones. Loosening the other lace lock 19 of the lower zone of action 12*c*, as required in the prior art, is therefore not absolutely necessary.

The proposed lacing arrangement, in addition to allowing the boot to be closed in only some portions or section-dependently, therefore also renders the boot quick and easy to step into and out of as a result of the directly functionally connected zones of action 12*a*, 12*b*, 12*c*.

In addition, the proposed lacing arrangement can be implemented using fewer guide hooks than the lacing arrangement known from DE 20 2004 019 82 U1. This is because of the extended lace loop 14 arranged in the place of the guide hook provided on one side of the tongue, the lace loop as it were replacing the guide hook. As a result, the friction of the bootlace during tightening and slackening is also reduced, so that ease of operation is improved.

LIST OF REFERENCE NUMERALS

10 lacing arrangement
11 bootlace
12*a* upper zone of action
12*b* middle zone of action
12*c* lower zone of action
13 lace-tightening device
14 lace loop
15 lace guide hooks
16 guide
17 free end
18 freely movable grip tab
19 lace lock

What is claimed is:

1. A boot having a lacing arrangement comprising a single bootlace operative to exert a lacing action in three zones of the boot namely:

an upper zone of action, a middle zone of action, and a lower zone of action, said middle zone of action, in respect of lacing up and opening the boot, having a direct functional connection both to said upper zone of action and to said lower zone of action, wherein said upper and lower zones of action are each associated with a lockable lace-tightening device, the lace tightening device comprising a portion of the bootlace in the form of an extended loop arranged to be manipulated for opening and closing the boot, and wherein a free end of said lace loop is, in each case, guided through a grip tab that is freely movable along the lace loop.

2. The boot according to claim 1, wherein said upper and lower zones of action each comprise a plurality of lace guide hooks, said lace-tightening device being arranged between two lace guide hooks.

3. The boot according to claim 2, wherein said lace-tightening device is arranged between two directly consecutive lace guide hooks.

4. The boot according to claim 1, wherein said lace loop is in each case arranged in a guide provided in and/or on said boot, and the free end of said lace loop is accessible for operating said lace-tightening device.

5. The boot according to claim 4, wherein said guide comprises two tubes, through each of which one of the two loop-forming, extended portions of said bootlace is guided.

6. The boot according to claim 3, wherein said lace loop is in each case guided through a lace lock attached to the boot.

7. The boot according to claim 6, where said lace loop is in each case guided through a lace lock attached to the leg of the boot.

8. The boot according to claim 1, wherein the two ends of said bootlace are joined to the boot.

* * * * *